US005704174A

United States Patent [19]

Dal Lago

[11] Patent Number: 5,704,174

[45] Date of Patent: Jan. 6, 1998

[54] PREFABRICATED INDUSTRIAL FLOOR

[75] Inventor: Alberto Dal Lago, Milan, Italy

[73] Assignee: DLC S.r.l., Milan, Italy

[21] Appl. No.: 703,733

[22] Filed: Aug. 27, 1996

Related U.S. Application Data

[63] Continuation of Ser. No. 331,809, Oct. 31, 1994.

[30] Foreign Application Priority Data

Nov. 9, 1993 [IT] Italy ..... MI93A2373

[51] Int. Cl.[6] ..... E04C 2/52

[52] U.S. Cl. ..... 52/220.5; 52/223.6; 52/250

[58] Field of Search ..... 52/223.9, 223.11, 52/223.1, 223.6, 223.12, 220.5, 220.7, 220.8, 220.4, 220.2, 220.3, 126.2, 126.5, 250; 174/48, 49

[56] References Cited

U.S. PATENT DOCUMENTS

| | | | |
|---|---|---|---|
| 4,586,303 | 5/1986 | Jartoux et al. | 52/223.6 X |
| 4,620,400 | 11/1986 | Richard | 52/223.9 |
| 4,627,203 | 12/1986 | Presswalls et al. | 52/223.6 X |
| 5,291,704 | 3/1994 | Savorani | 52/223.9 X |
| 5,437,072 | 8/1995 | Dinis et al. | 52/223.11 X |
| 5,577,284 | 11/1996 | Muller | 52/223.6 X |

*Primary Examiner*—Carl D. Friedman
*Assistant Examiner*—Creighton Smith
*Attorney, Agent, or Firm*—Hedman, Gibson & Costigan, P.C.

[57] ABSTRACT

A prefabricated industrial floor for forming a multi-storey prefabricated structure consisting of an interlocking node frame with a capital totally contained within the floor thickness (19), formed from a plurality of tile elements (11) arranged side by side parallel to each other which do not require the laying of a make-up casting, which can have the floor surface already incorporated, and which form a service compartment (22) on the ceiling side and a service compartment (21, 32) on the flooring side, both inspectionable, and from tile support beams (20) which are produced with the same equipment and have the same soffit appearance. The capital, beams and tiles are provided with a series of holes (24, 24') which lighten the structure, which cannot be seen, and which can be used for service passages or for floor stiffening cross-members (25). The structure, of high fire resistance, is designed so that, without any formal variation, the tile (11) can be replaced by a beam (edge beam, wind beam, beam for high concentrated loads).

6 Claims, 12 Drawing Sheets

PREFABRICATED INDUSTRIAL FLOOR

This application is a continuation of Ser. No. 08/331,809 filed Oct. 31, 1994.

This invention relates to an industrially produced prestressed concrete floor of variable height for forming multistorey prefabricated structures.

Many different floor elements are currently available, such as to enable a large number of different floor arrangements to be constructed.

A system which can be taken as reference is the double-T system, even though it competes for small heights with the multi-hole extruded floor the production of which is limited to a height of 40 cm. In addition the double-T system offers considerable versatility and a wide capacity range. However the double-T system found itself in crisis when the market began to insist on a small height, a high fire resistance (90–120 minutes) end a flat soffit for movable partitions.

If the penalizing technical characteristics of the double-T system are analyzed, it can be stated that its formation with a very high center of gravity is not the most suitable for a floor. In this respect the limit to the use of the double-T system derives from its small mass at its lower edge, which poses a limit on the maximum prestressing reinforcement.

In addition because of its high center of gravity the double-T floor suffers from a considerable rise and hence the danger of large rise differences.

The considerable rise is a drawback, the rise variation creating a step between two adjacent tiles requiring a make-up casting sometimes of large height, so much so that the rise difference becomes absolutely unacceptable end a just reason for serious dispute.

Consequently a floor is needed having a cross-section characterised by a center of gravity at approximately half its height and hence with very similar section moduli ($W_s$ and $W_i$). This is not so in the case of the double-T system slab, which for its final strength has an overabundant width the purpose of which is to support a compression cap cast in situ and suitably reinforced, to provide load distribution and planarity of the flooring.

An object of the invention is to obviate these drawbacks by providing a price-competitive profabricated floor of high technical performance, low weight and considerable utilization versatility and functionality.

A further object is to provide a highly industrialized profabricated floor of height between 25 and 125 cm, without a cooperating cap.

These objects are attained by an industrial floor with the characteristics defined in the accompanying claims.

The structural and functional characteristics of the invention and its advantages over the known art will be more apparent from an examination of the following description given with reference to the accompanying schematic drawings, which show one embodiment of an industrial floor incorporating the principles of the invention.

On Use drawings:

FIGS. 2 and 22 show minimum and maximum width spacings for tiles of FIG. 19;

With reference to the figures, a profabricated industrial floor according to the invention is indicated overall by 10 and is formed structurally from a plurality of tile elements 11 positioned side by side and parallel to each other.

Figure 19:
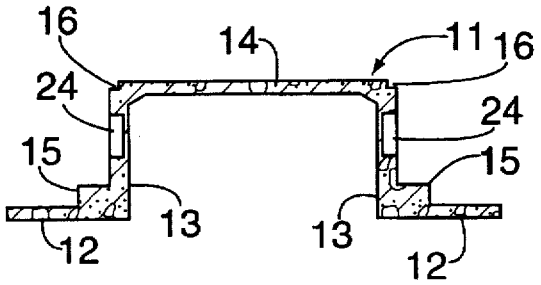
FIG. 19 is a section on an enlarged scale through a maximum-dimension single tile forming part of a floor according to the invention.
Figure 29:
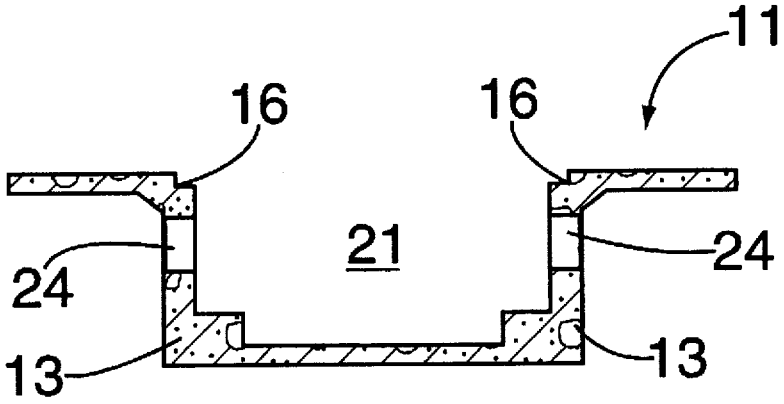
FIGS. 29 and 30 show a further two types of tile element additional to that shown in FIG. 19.
Figure 30:
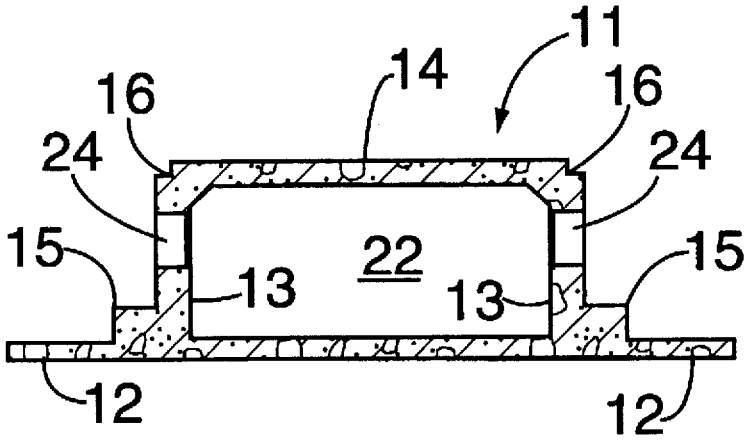

The tile elements 11 can have three types of cross-section as shown in FIGS. 19, 29 and 30.

The drawings substantially relate to the cross-section shown in FIG. 19 comprising two lower base flanges 12 and an upper connection slab or central portion 14. The variable height ribs are of constant section.

Within the connection regions between the base flanges 12 and the variable-height side walls 13 the tile elements 11 comprise thickened stiffening portions 15 containing the prostressing, which is protected from fire by considerable overlap.

Figure 24:
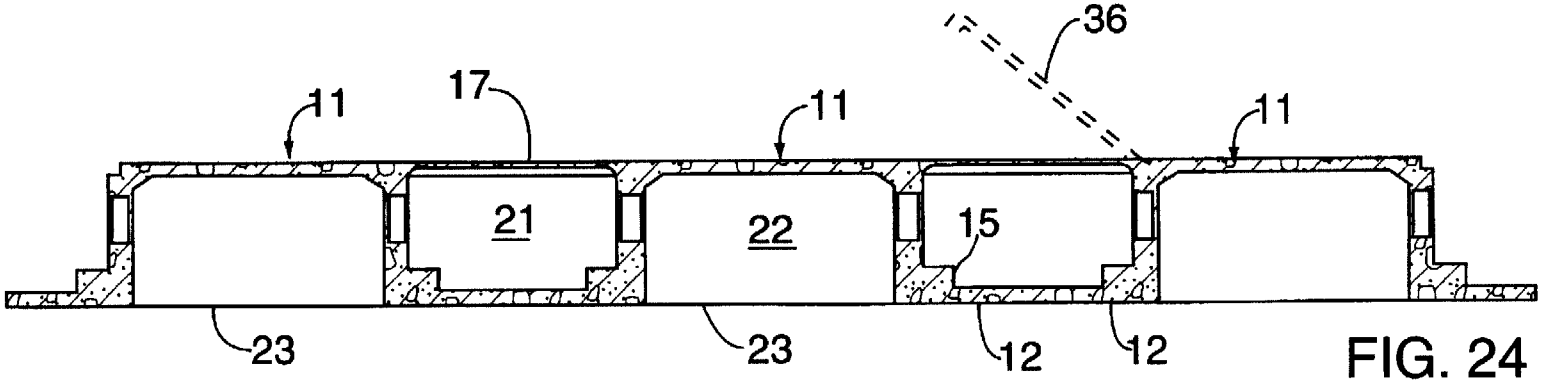
Figure 25:
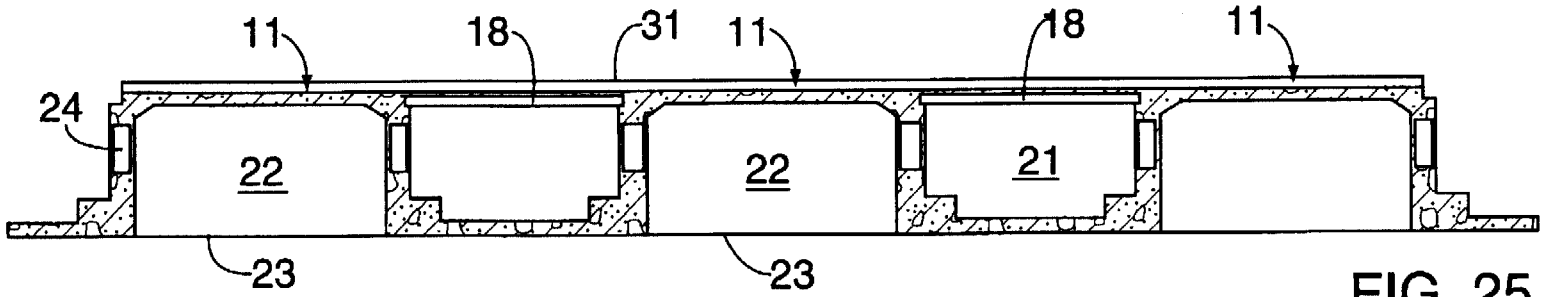

Within the connection region between the side walls 13 and the central portion 14 the tile elements 11 are provided with external recesses 16 for housing cover elements such as reinforcers 17 (FIGS. 23 and 24) or plate portions 18 (FIG. 25).

Beams 20 shaped in the form of the aforesaid tile elements are provided according to the present invention at columns 19 with their capital totally contained within floor thickness for supporting the floor according to the present invention.

In a preferred embodiment the tile elements 11 in combination with beams 20 and capital columns 19 form a framed multi-storey structure (FIG. 26) in which a structural continuity can be achieved between the tile elements 11 and beam 20 and between the capital end beam.

Figure 8:
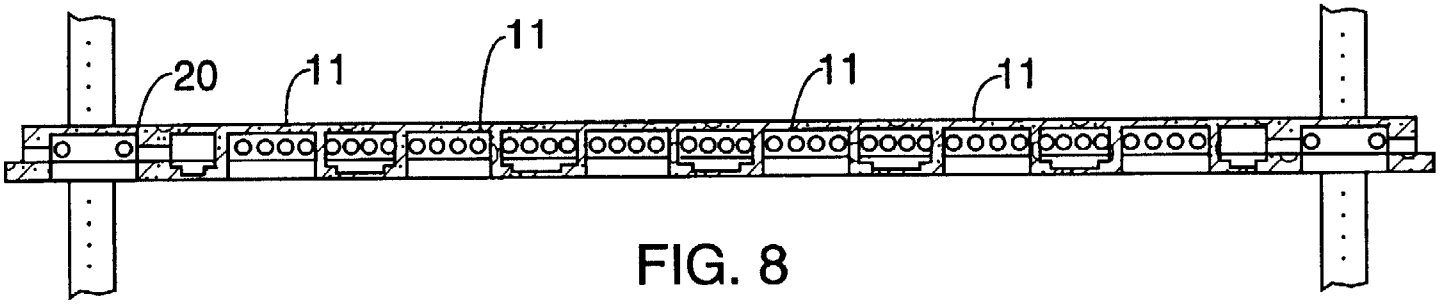
FIG. 8 is a section on the line F'—F' of FIG.1.
Figure 9:
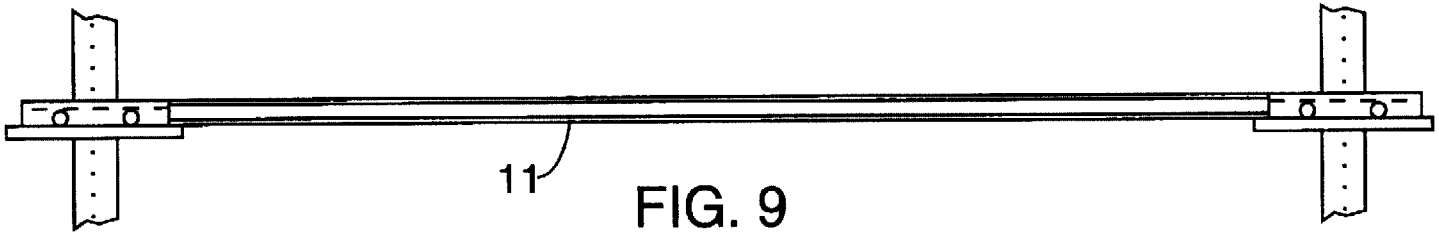
FIGS. 9, 10, 11, 12, 13, 14 and 15 are sections through an embodiment of the floor according to the invention with beams not totally contained within the floor thickness, taken on the same lines as FIGS. 2, 3, 4, 5, 6, 7 and 8.
Figure 10:
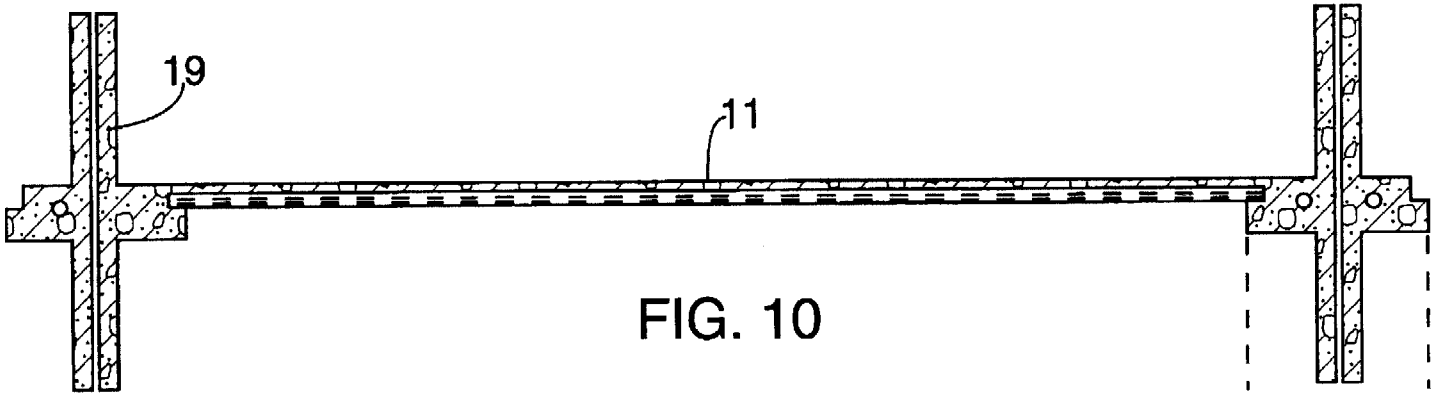
Figure 11:
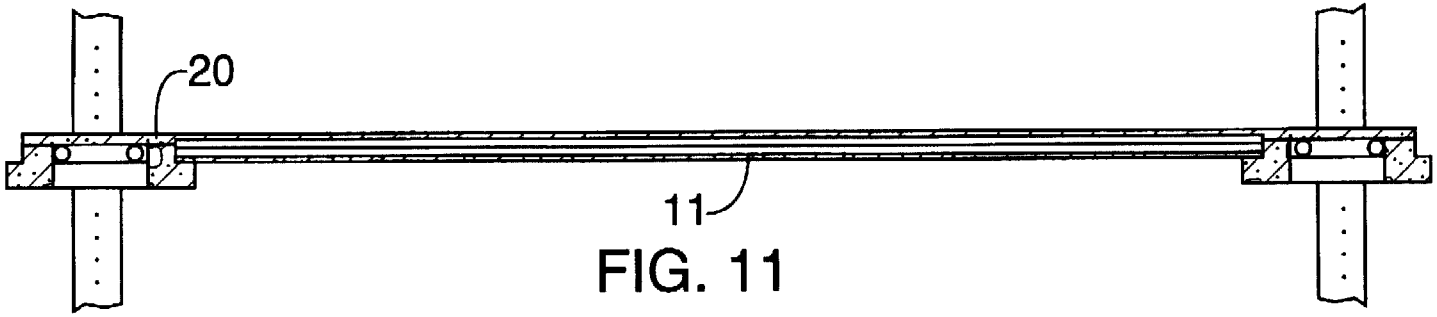
Figure 12:
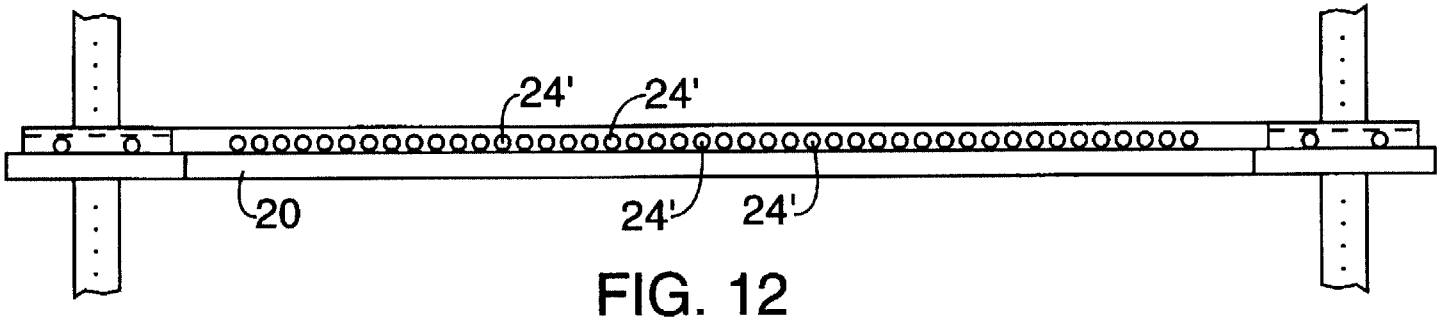
Figure 13:
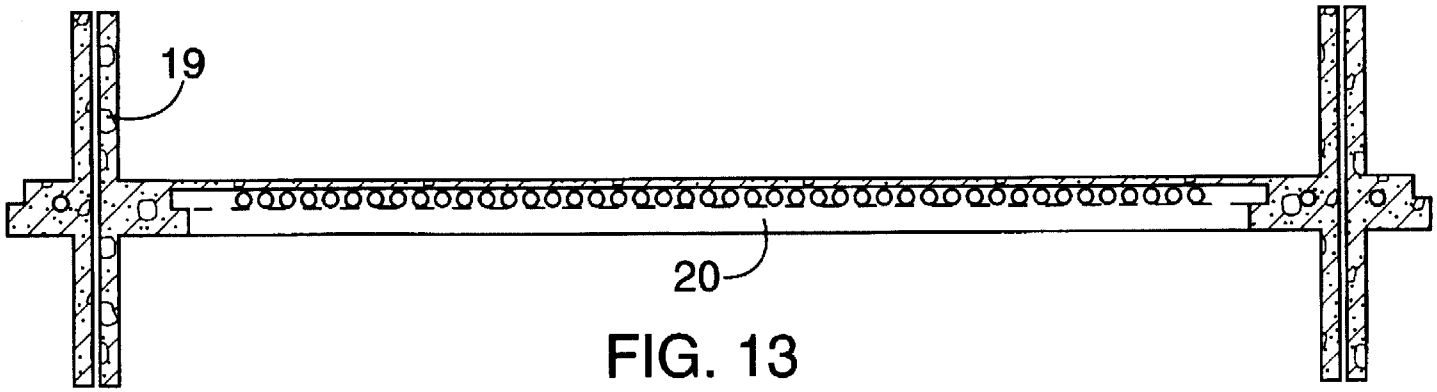
Figure 14:
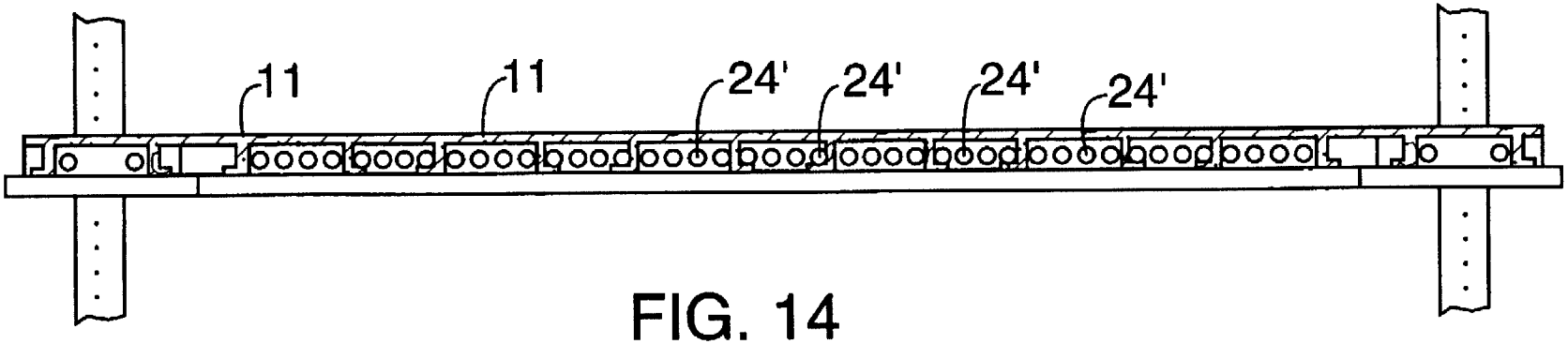
Figure 15:
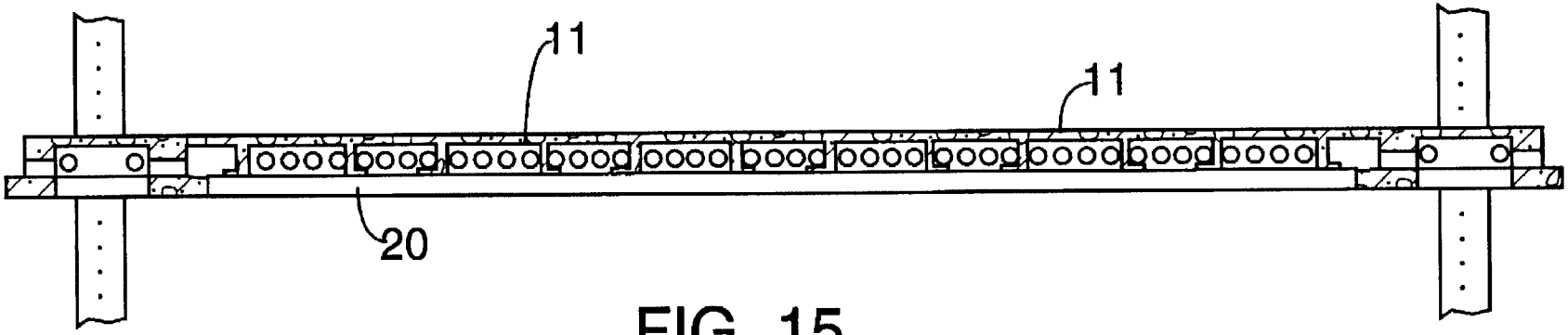

The frame can be formed in the two directions by replacing the tile at the column with a beam having a soffit of form identical to the tile (see FIG. 8).

The tile elements 11, positioned side by side along a lower edge, leave a space within the floor on the flooring side. To achieve a flat extrados cover plates have to be inserted between the two tiles.

By arranging these cover elements between the various side-by-side tile elements 11 a floor surface can be formed without thickness discontinuity points, this also being able to be done during the tile end cover element production.

The floor according to the invention has the special characteristic of forming a series of service compartments on both the flooring side end ceiling side.

The service compartments 21 on the flooring side are open during construction and are closed by cover plates which can be removed if there is no make-up casting. Possibly and as an alternative, if there is a make-up casting, trapdoors 36 can be provided giving access to the formed ducts 21.

Service ducts 22 on the ceiling side, or compartments for similar uses, can be formed in the ceiling with the facility for achieving lower closure of the central part of each tile element 11, for example using a false-ceiling element 23 positioned in line with the floor soffit, hence forming a flat soffit.

Applying such false ceiling-work to the floor not only enhances appearance but also allows the compartment to be inspected and eliminates acoustic reverberation.

For particular enhancing applications the false ceiling elements can consist of elements equipped for current sockets, lights, heaters or other needs.

The tile elements 11 and beams 20 are provided with a plurality of holes 24 and 24' which can be through holes, or be closed with 1 cm of concrete to lighten the elements without the holes being visible and be able to distribute services to all points of the floor by removing the small thickness of concrete, or for providing stiffening elements or cross-members 25.

Examining in greater detail FIGS. 1 to 8, these show a floor 10 consisting of tile elements 11 and beams 20 totally contained within floor thickness.

The various sections show the side walls 13 holed at 24 within the tile elements 11 to receive as required the stiffening elements 25 in the number and position determined by the stresses.

Figure 1:
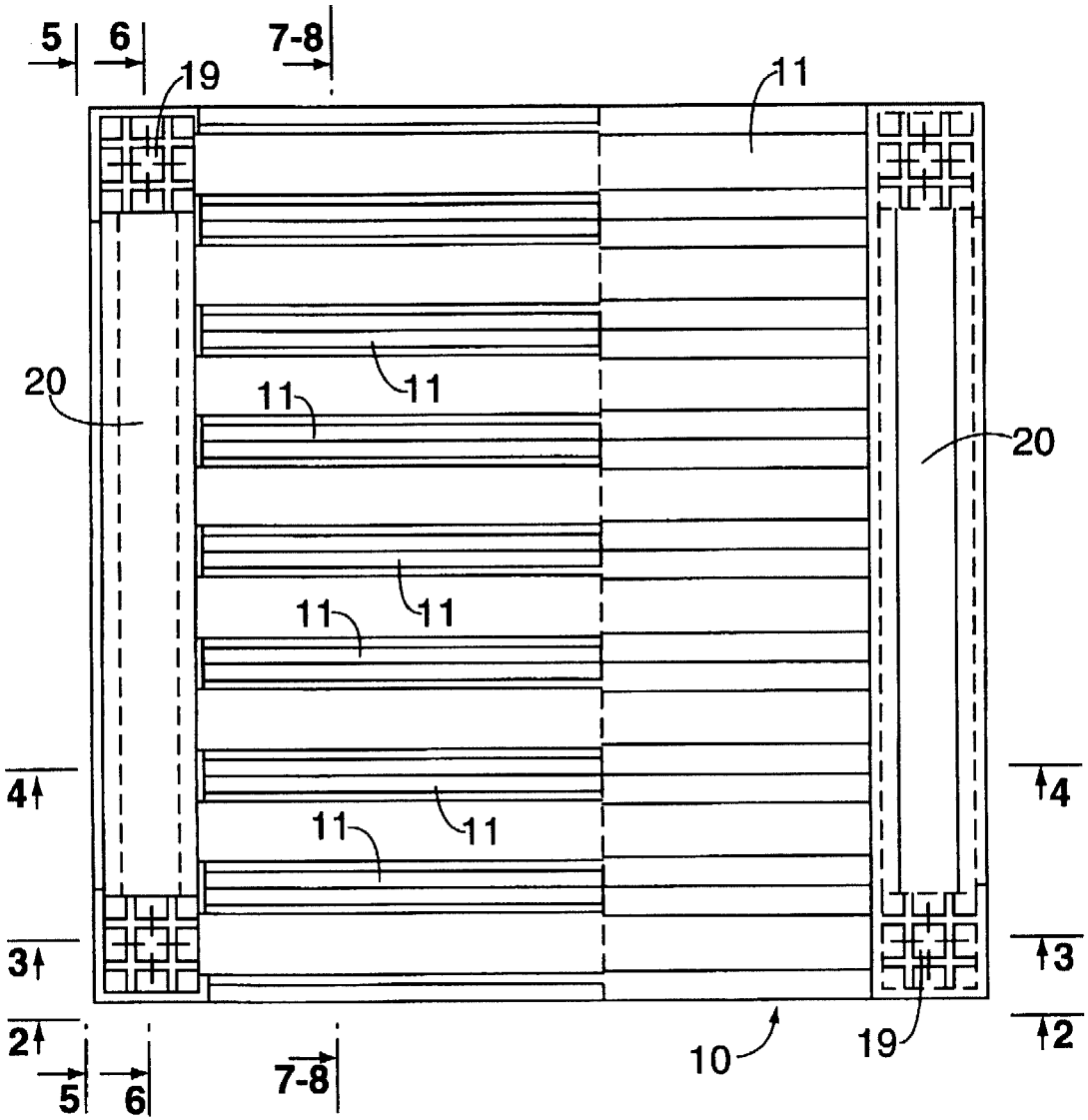
FIG. 1 is a plan view showing an industrial floor according to the invention with beams totally contained within the floor thickness.
Figure 2:
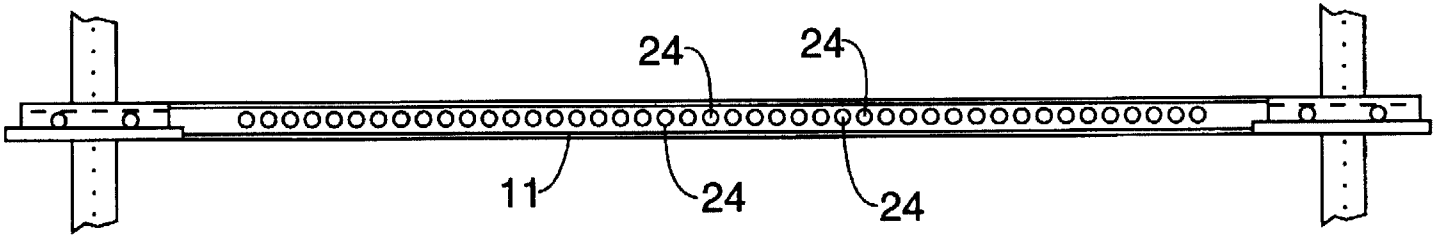
FIG. 2 is a side elevation of the floor of FIG. 1 on the line A—A.
Figure 3:
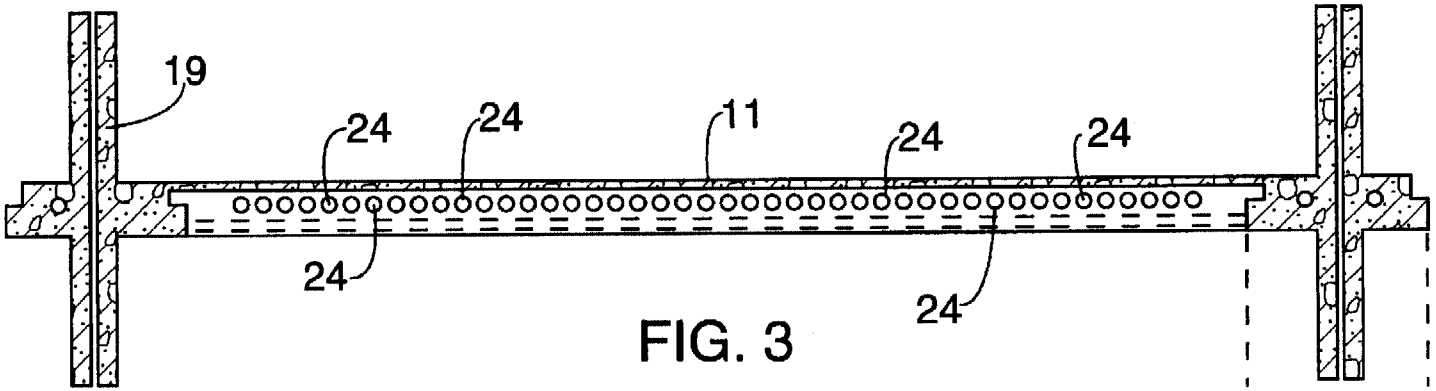
FIG. 3 is a section on the line B—B of FIG. 1.
Figure 4:
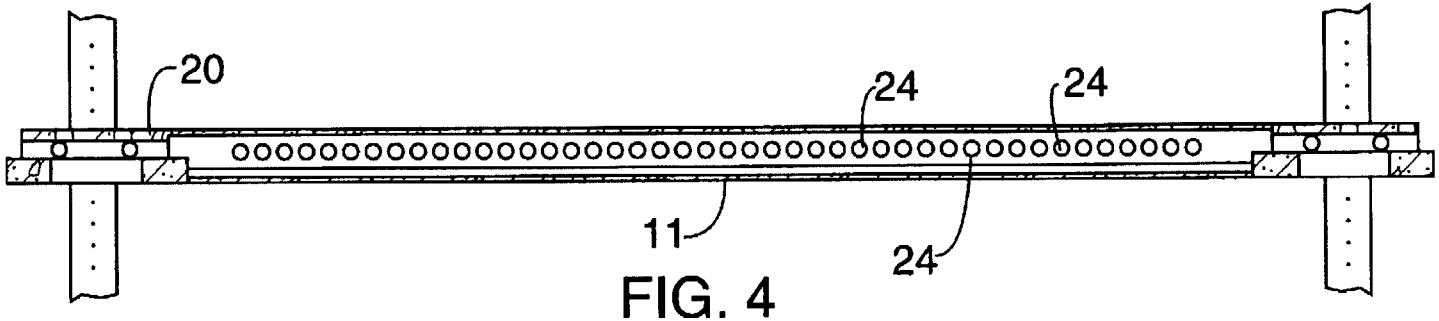
FIG. 4 is a section on the line C—C of FIG. 1.
Figure 5:
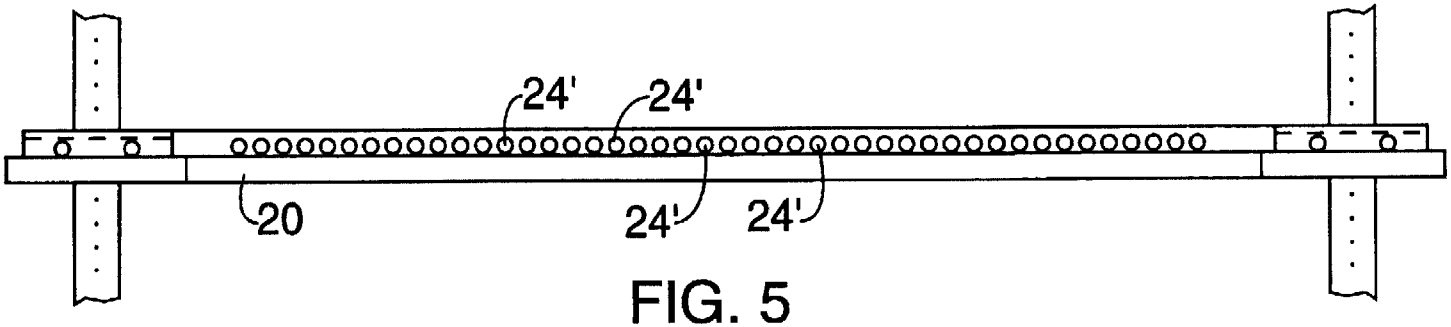
FIG. 5 is a side elevation of the floor on the line D—D of FIG. 1.
Figure 6:
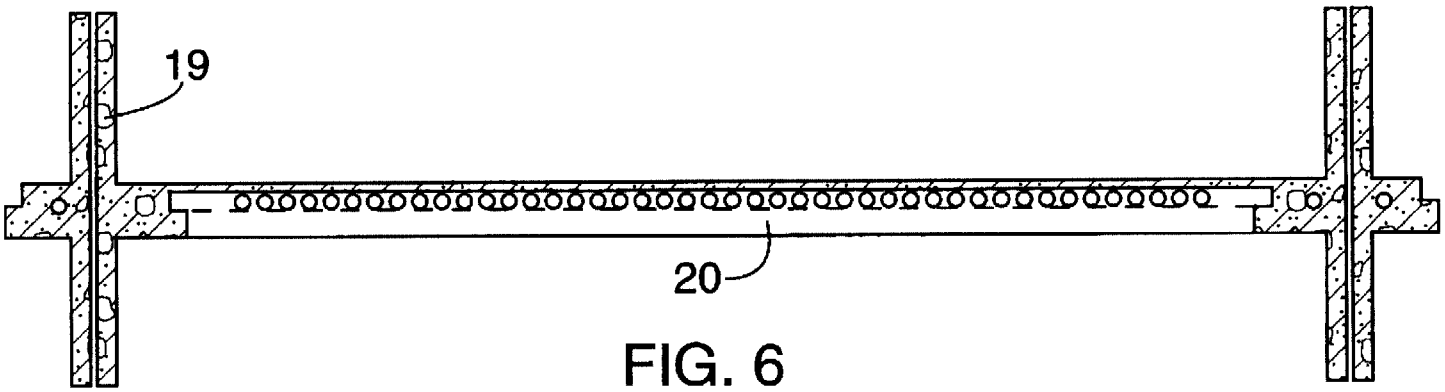
FIG. 6 is a section on the line E—E of FIG. 1.
Figure 7:
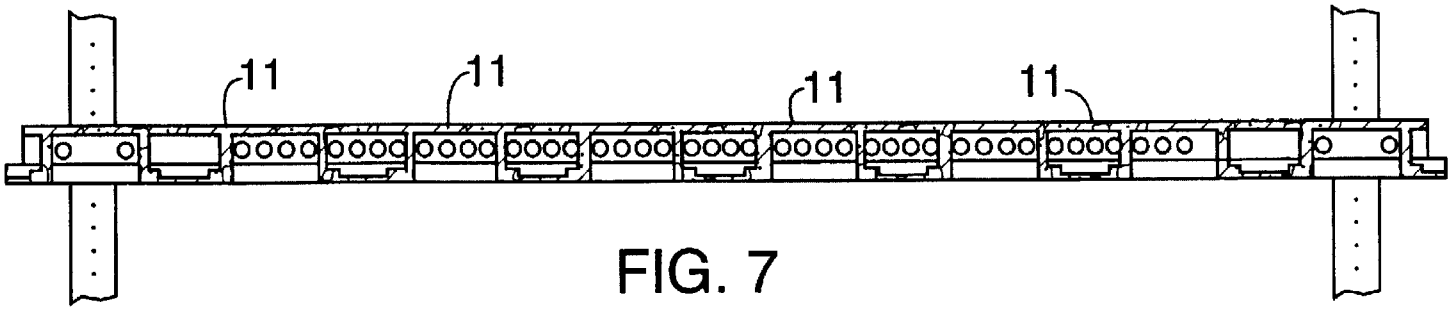
FIG. 7 is a section on the line F—F of FIG. 1.
Figure 16:
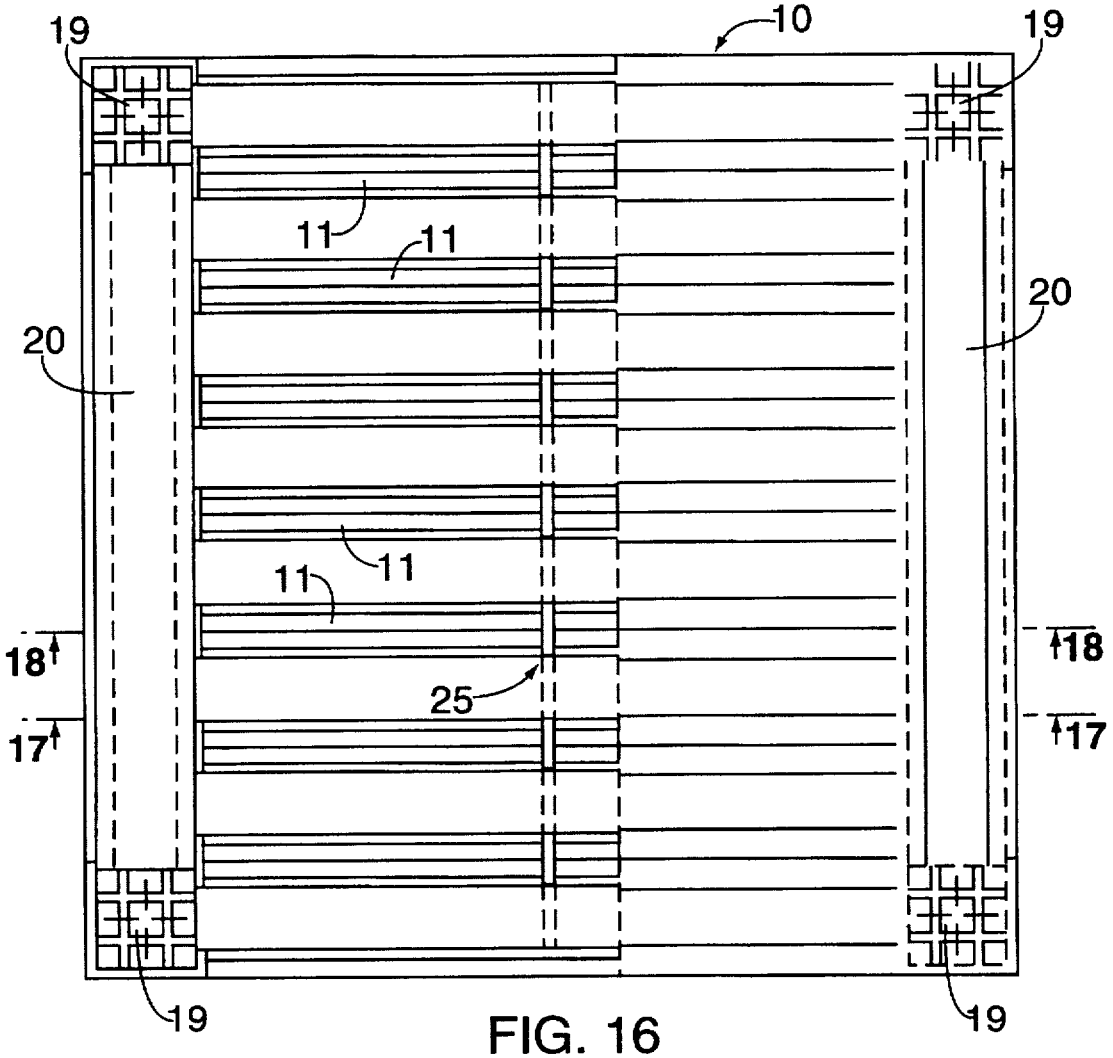
FIG. 16 is a plan view of a floor provided with a stiffening cross-member.
Figure 17:
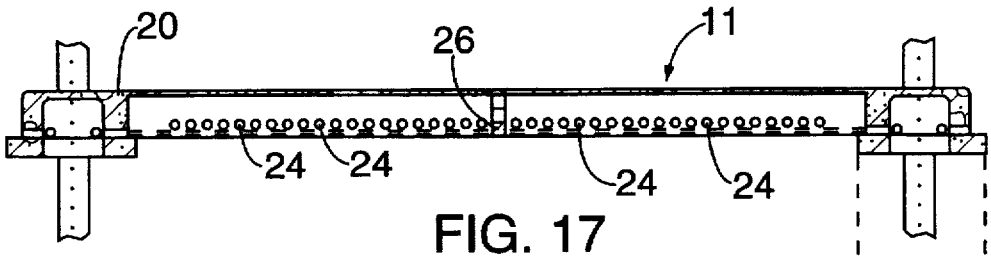
FIGS. 17 and 18 are sections on the lines X—X and Y—Y of FIG. 16.
Figure 18:
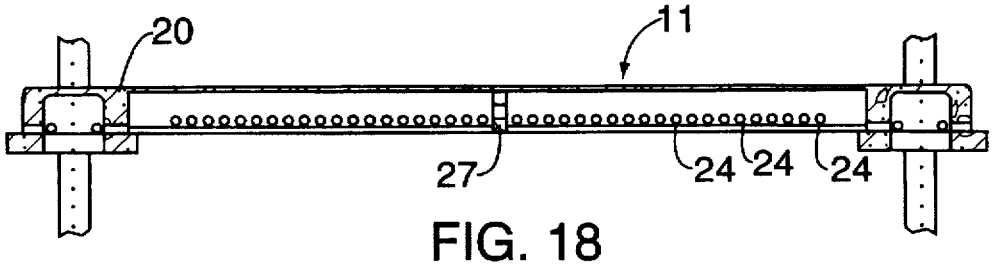

FIG. 9 to 15 show sections through the lines indicated in FIG. 1, of a floor 10 consisting of tile elements 11 with a beam 20 not totally contained within its thickness, FIGS. 16 to 18 are partial plan views and two sections through the lines indicated thereon, showing a floor 10 according to the present invention formed with a beam not totally contained within its thickness.

Advantageously, in this example a stiffening cross-member 25 is shown extending through a plurality of tile elements 11. The stiffening element 25 consists of tubular portions 26 alternating with wall portions 27.

Figure 20:
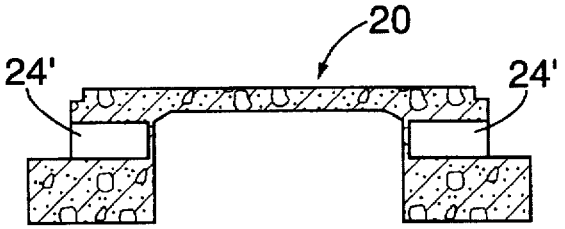
FIG. 20 is a section on an enlarged scale through a beam forming part of a floor according to the invention.

FIGS. 19 and 20 show on an enlarged scale a section through a tile 11 and, respectively, through a beam 20 in which their constructional difference can be seen. The beam 20 can also comprise holes 24' for the passage of services or for receiving reinforced stiffening baffles.

Figure 21:
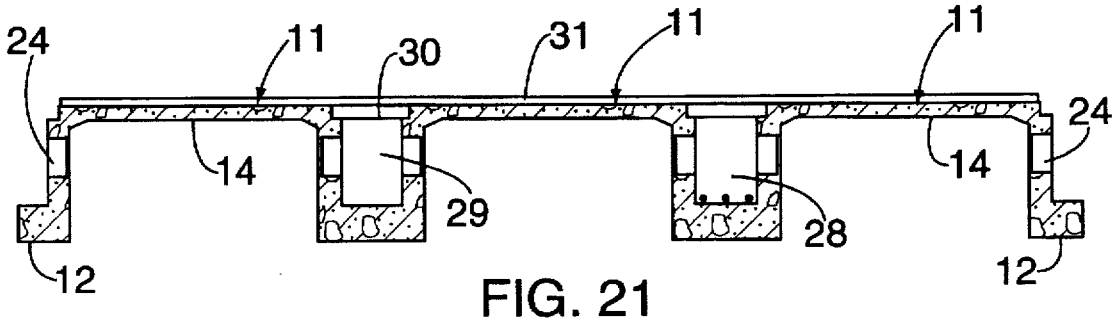

FIG. 21 shows how a minimum spacing between the various tiles 11 is achieved in the composition of the floor 10 using a tile element 11 having base flanges 12 of minimum size. In those spaces formed between one tile and the next a make-up casting 28 can be laid if necessary, or a duct 29 can be created by providing a suitable cover element 30 of plate metal or the like, with an upper make-up casting 31.

Figure 22:
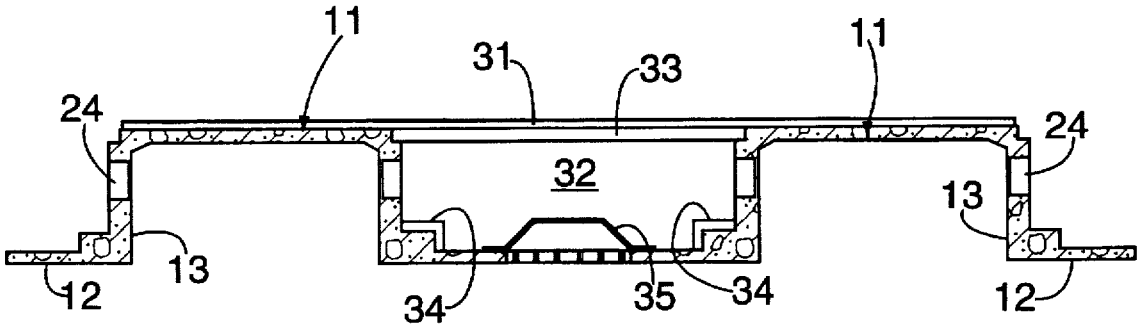

FIG. 22 shows a further embodiment of part of a floor in which there is maximum width spacing between one tile and the next. In this case the interspace between two adjacent tiles defines a wide compartment or duct 32 closed upperly by a metal grating 33 and into which stiffening elements 34 can be inserted, such as reinforcers of greater fire resistance, plus possibly additional lower closure elements 35.

Figure 23:
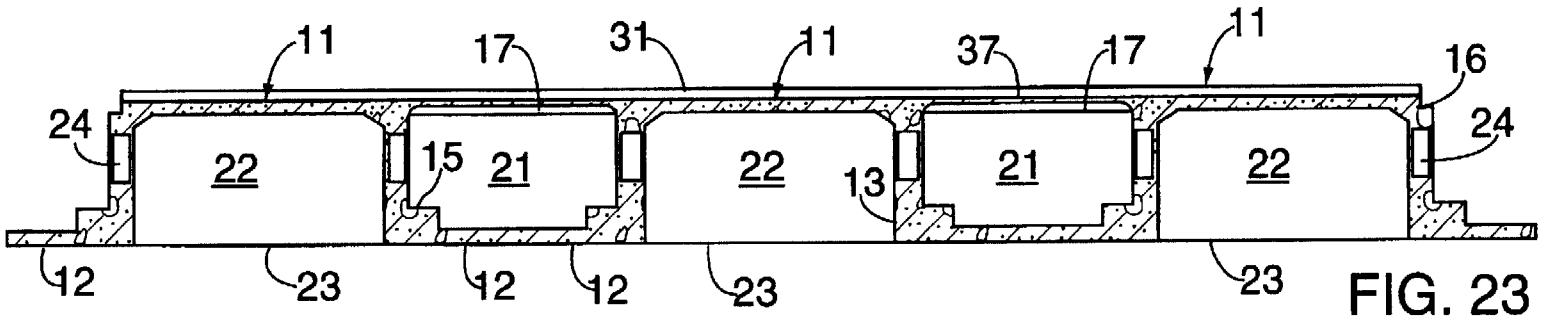
FIGS. 23, 24 and 25 are sections through different arrangements of tiles according to the invention.

FIGS. 23, 24 and 25 show some typical applicational arrangements of a prefabricated industrial floor according to the present invention.

FIG. 23 shows a first arrangement in which reinforcers 17 are inserted into the appropriate outer cavities 16 between two successive tile elements 11. The floor 10 can then be completed upperly by laying a make-up casting 31, and each tile element 11 can be closed lowerly by a false ceiling element 23. An inspection panel 37 can be provided in the make-up casting.

FIG. 24 shows a second arrangement, totally similar to the preceding, in which the make-up casting is not laid on the upper tile surface, and a trapdoor 36 is indicated.

Finally FIG. 25 shows a third arrangement, of the many possible arrangements, in which a ribbed plate for example of galvanized sheet 18 is located between two successive tile elements 11 to form ducts 21. A make-up casting 31 upperly completes the floor according to the invention. Possible false ceiling elements 23 complete the floor lowerly.

Different elements can be connected together to form service passages in a floor according to the invention by providing a plurality of holes 24 and 24' in the side walls of the tile elements 11 and beam elements 20.

The strands are housed in the required optimum arrangement within the enlarged portions 15 between the base flanges 12 and the side walls 13. This localized housing makes it possible to create different sized base flanges, enabling the floor to be closed on the basis of particular constructional requirements.

Advantageously it has been seen that a prefabricated industrial floor according to the invention is of low weight by reducing the use of materials to a minimum, in particular concrete. In this manner the cost is reduced and transport facilitated for a product of excellent quality.

Figure 26:
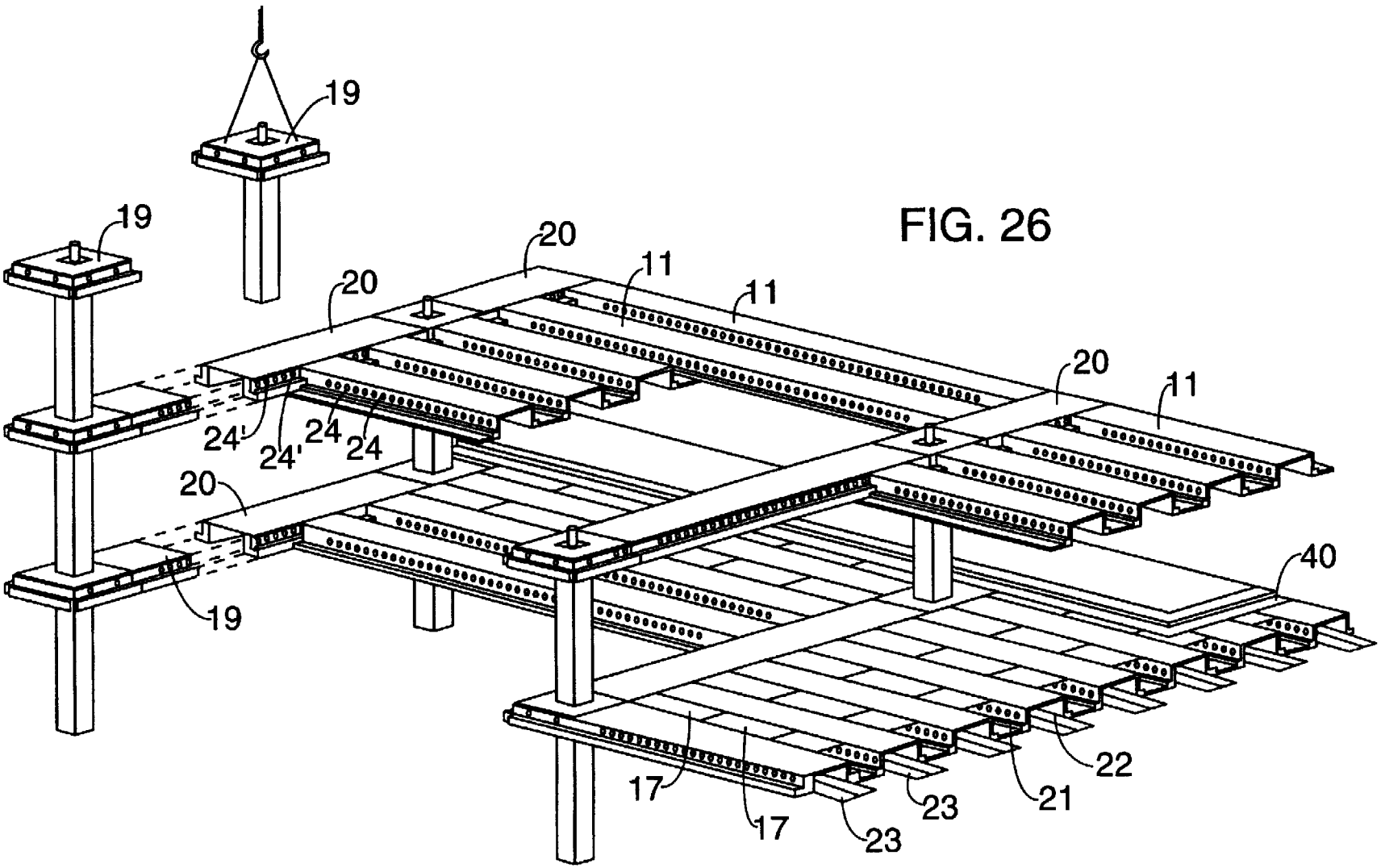
FIG. 26 is an isometric view of a multi-store structure formed with floors of the invention.

FIG. 26 is an isometric view of a multi-storey structure formed using floors of the invention with an interlocked node frame, formed with capital columns totally contained within the floor thickness 19 and tile elements 11 without a make-up casting. Ceiling service compartments 22 or 32, floor service compartments 21 and edge or main beams 20 can be seen.

Figure 27:
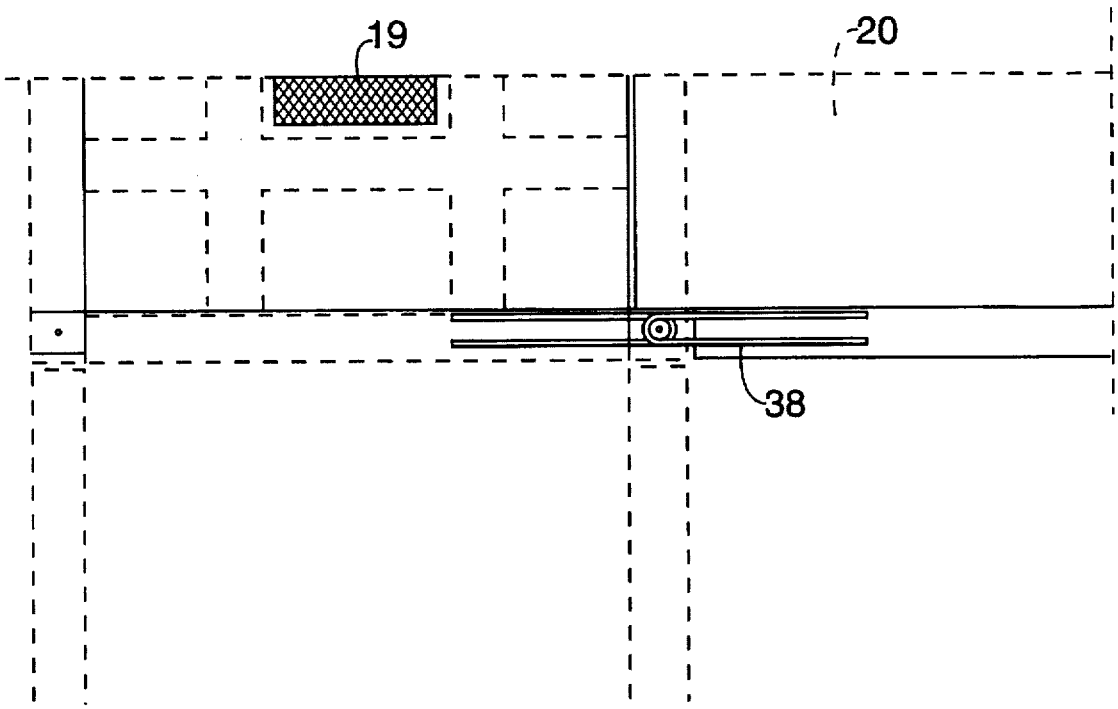
FIGS. 27 and 28 are detailed views showing the joint between a beam and a capital column.
Figure 28:
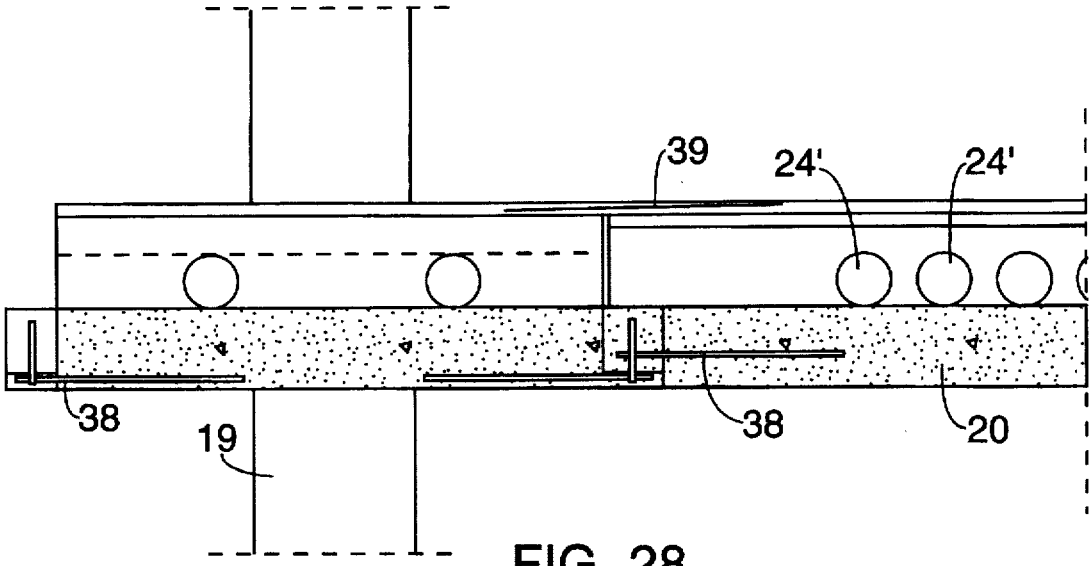

FIGS. 27 and 28 show details of the connection between a beam and capital column for achieving continuity by providing lower reinforcement 38, with upper reinforcement 39 in the possible cap 40.

I claim:

1. A prefabricated industrial preformed concrete floor formed from a plurality of tile elements of variable height arranged side by side parallel to each other, characterized in that said side-by-side tile elements (11) form a series of service compartments (21, 22, 32) having a treading surface and defined apertures said service compartments being open at least at said treading surface, and having closure plates (17, 18, 30, 33) which are positionable at said defined apertures to provide coplanarity of said floor and to distribute loads without laying a make-up concrete casting and to form a finished floor surface, and having in each of said tile elements (11), side walls (13), said side walls being provided with a plurality of holes (24) said floor also having main frame beams (20) of variable height said main frame beams (20) having an upper and a lower surface said lower surface being in register with said tile elements (11) to provide coplanarity of said floor.

2. An industrial floor as claimed in claim 1, characterised in that main frame beam (20) of variable height are provided having their soffit identical to said tile element (11).

3. An industrial floor as claimed in claim 1 or 2, characterised in that each of said tile elements (11) is provided with a plurality of holes (24) in its side walls (13).

4. An industrial floor as claimed in claim 2, characterised in that said main frame beams (20) are provided with a plurality of holes (24') in side walls.

5. An industrial floor as claimed in claim 1, characterized in that the side-by-side tile elements (11) have undersides which form underside service compartments (22) whereby said underside service compartments are closable by false ceiling elements (23) which form a flat soffit.

6. A prefabricated industrial prestressed concrete floor with a floor thickness, said floor consisting essentially of a plurality of tile elements of variable height arranged side by side parallel to each other and having side-by-side tile elements (11) which form a series of service compartments (21, 22, 32) having a treading surface and defined apertures said service compartments being open at least at said treading surface, and having closure plates (17, 18, 30, 33) which are positionable at said defined apertures to provide coplanarity of said floor and to distribute loads without laying a make-up concrete casting and to form a finished floor surface, said tile elements being supported by an interlocked node frame formed with capital columns, said tile elements, said interlocked node frame and said capital columns being contained within the floor thickness without a make up casting.

* * * * *